US005110168A

United States Patent [19]

Petrillo

[11] Patent Number: 5,110,168

[45] Date of Patent: May 5, 1992

[54] GOLF BALL RETRIEVER

[76] Inventor: John Petrillo, Sherwood Hill Rd., Brewster, N.Y. 10509

[21] Appl. No.: 541,849

[22] Filed: Jun. 21, 1990

[51] Int. Cl.[5] ..... A63B 47/02

[52] U.S. Cl. ..... 294/19.2; 56/400.11

[58] Field of Search ..... 294/19.2, 50.6, 400.01, 294/400.04, 400.09, 400.11, 400.12, 328.1; 273/32 F, 32 G, 162 E, 162 B, 162 F

[56] References Cited

U.S. PATENT DOCUMENTS

| | | | |
|---|---|---|---|
| 698,226 | 4/1902 | Roberts | 294/19.02 |
| 704,848 | 7/1902 | Minton | 294/19.02 |
| 1,014,250 | 1/1912 | Norman | 56/400.11 |
| 1,095,585 | 5/1914 | Mack | 56/328.01 |
| 2,110,538 | 3/1938 | Walsh | 294/19.02 |
| 2,270,632 | 1/1942 | Hasty | 294/19.02 |
| 2,724,610 | 11/1955 | Fitzgerald | 294/19.02 |
| 3,046,044 | 7/1962 | Christle | 294/19.02 |
| 3,115,740 | 12/1963 | Hartley et al. | 56/400.01 |
| 3,614,149 | 10/1971 | Clark | 294/19.02 |
| 3,717,371 | 2/1973 | Halone | 294/19.02 |
| 3,979,146 | 9/1976 | Berg | 56/400.11 X |
| 4,138,153 | 2/1979 | Brown | 15/257.01 X |
| 4,216,831 | 8/1980 | Ritchie | 294/19.02 X |
| 4,254,981 | 3/1981 | Wilson | 294/19.02 |
| 4,635,987 | 1/1987 | Hurtgam | 294/19.02 |
| 4,730,859 | 3/1988 | Gabinet | 294/19.02 |
| 4,828,690 | 5/1989 | Montez | 56/400.11 |
| 4,957,319 | 9/1990 | Bontempo | 294/19.02 |

FOREIGN PATENT DOCUMENTS

| | | | |
|---|---|---|---|
| 0469482 | 7/1937 | United Kingdom | 294/19.02 |

*Primary Examiner*—Margaret A. Focarino
*Assistant Examiner*—Dean J. Kramer
*Attorney, Agent, or Firm*—Leo Zucker

[57] ABSTRACT

A golf ball retriever includes a head part having a forward frame part and a rear frame part. The forward frame part has upper and lower parallel leading members defining a rectangular mouth opening sufficiently wide to allow a retrieved golf ball to enter. The rear frame part has a lower trailing member which defines a rear seat edge parallel to the lower leading member. The seat edge is spaced from the lower leading member a distance slightly less than the diameter of a golf ball. Retrieved golf balls that enter the mouth opening are then seated or cradled securely between the rear seat edge and the lower leading member, and will thus tend to remain in place as the retriever continues to be moved about. A detachable handle, which may include a golf club or a telescoping pole, can be easily clamped to the head part when needed. Tooth-like projections extending from the forward leading member help to dislodge golf balls embedded in land or out of view in the bottom surface of a pond. The projections can also serve as a sand rake.

15 Claims, 2 Drawing Sheets

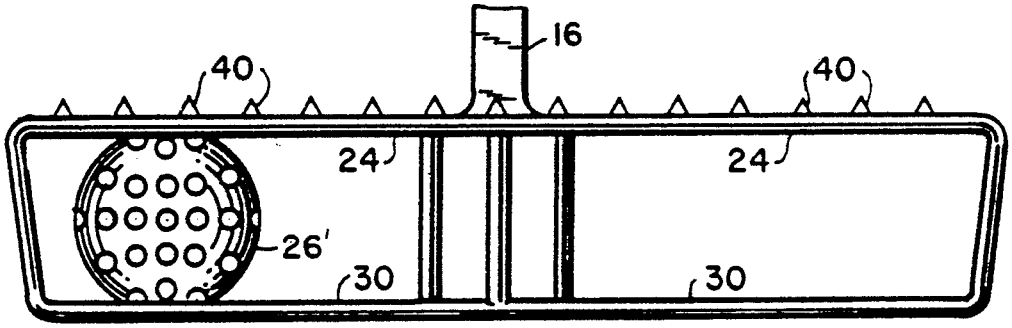
FIG.3
FIG.4
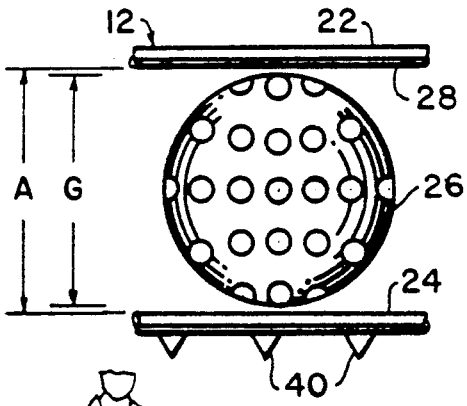
FIG.5
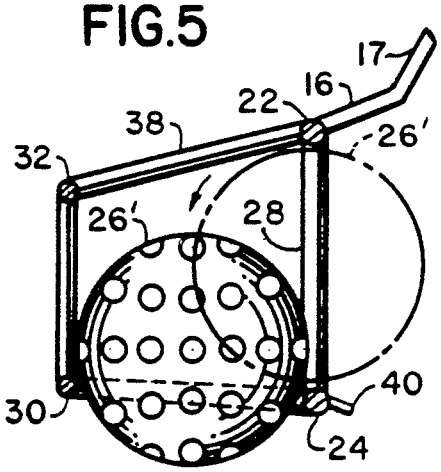
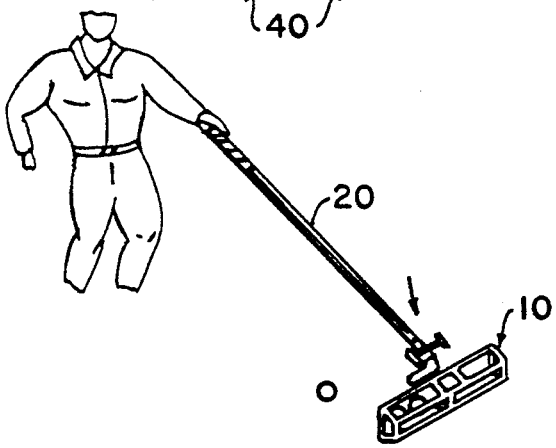
FIG.6
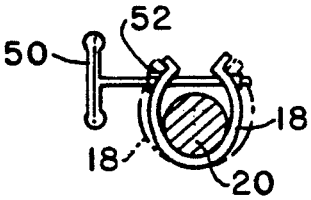
FIG.7

GOLF BALL RETRIEVER

BACKGROUND OF THE INVENTION

I. Field of the Invention

The present invention relates to golf ball retrievers, and more particularly to a golf ball retriever capable of reliably retrieving golf balls embedded on land, in sand, as well as golf balls lodged out of view on the bottom surface of a pond.

II. Description of the Known Art

Golf ball retrieving devices are known generally from, for example, U.S. Pat. Nos. 2,270,632 issued Jan. 20, 1942; 4,254,981 issued Mar. 10, 1981; and 4,635,987 issued Jan. 13, 1987.

In the golf ball retriever device of the '632 patent, an elongated wire-formed head part is connected to a handle section through a connecting member. The head part has a basket-like container formed at its central portion so as to receive a single golf ball once it enters the head part. That is, the wire-formed head part acts like a funnel to guide the retrieved golf ball into the central basket-like container portion. The device may be used to retrieve golf balls from water holes, under brush and other inaccessible places. The user must, however, have the ball always within sight so that the head part can be properly positioned to scoop up the ball.

The golf ball retriever of the '981 patent includes a set of retrieving fingers attached to a long handle via a flat plate. A sliding bar causes the fingers to spread apart to a position at which looped retrieving ends of adjacent fingers are spaced slightly less than the diameter of a golf ball.

In the retrieving device of '987 patent, an elongate retrieval head is adapted for retrieving golf balls from mud and silt as found at the bottom of a pond or stream. A set of curved tines and a lower stabilizing member cooperate to dislodge a ball from the mud, and to retrieve and hold the ball, according to the patent.

The known golf ball retrievers have a common disadvantage in that unless the golf ball or balls to be retrieved are within view on land or beneath a clear body of water, the golfer cannot be certain when the retrieving device has engaged and captured the ball to be retrieved. Also, some of the devices are capable of retrieving only one ball at a time and/or lack means for applying a dislodging force to golf balls that might be tightly embedded, for example, in mud at the bottom of a pond.

U.S. Pat. No. 4,216,831 issued Aug. 12, 1980, discloses a golf club attachment for raking sand traps and retrieving golf balls. A rake head has a tubular collar for engaging the butt end of a golf club shaft so that the latter can act as a handle. The rake head is not, however, capable of holding onto a retrieved golf ball should the rake head be lifted above ground.

SUMMARY OF THE INVENTION

An object of the invention is to overcome the above and other shortcomings among the known golf ball retrieving devices.

Another object of the invention is to provide a golf ball retriever capable of dislodging and retrieving golf balls from locations out of the view of the user, e.g., at the bottom of a muddy pond.

A further object of the invention is to provide a golf ball retriever capable of retrieving and holding several golf balls at a time.

Yet another object of the invention is to provide a golf ball retriever of such construction that the user will know by the "feel" of the device each time a golf ball is engaged and seated in a head part of the device.

Another object of the invention is to provide a golf ball retriever the head part of which can be easily carried by a golfer in his or her golf bag and, when needed for use, can be readily attached to the club end of a golf club, or to a separate telescoping handle.

A further object of the invention is to provide a golf ball retriever capable of manufacture from readily available materials and at relatively low cost.

According to the invention, a golf ball retriever includes an elongate head part for retrieving golf balls on land or from a body of water. The head part comprises a forward frame part which defines a generally rectangular mouth opening with parallel upper and lower leading members sufficiently spaced so that a stationary golf ball can enter the mouth opening when the lower leading member is swept beneath the golf ball. The head part also includes a rear frame part for preventing golf balls that enter the mouth opening from escaping, the rear frame part having parallel upper and lower trailing members spaced apart a distance less than the diameter of a golf ball. The lower trailing member defines a rear seat edge parallel to the lower leading member of the forward frame part, and is spaced from the lower leading member a distance slightly less than the golf ball diameter so that a golf ball will be seated between the rear seat edge and the lower leading member after entering the mouth opening. Also included is means for fixing one end of a handle to the head part.

For a better understanding of the present invention, together with other and further objects, reference is made to the following description taken in conjunction with the accompanying drawing, and the scope of the invention will be pointed out in the appended claims.

BRIEF DESCRIPTION OF THE DRAWING

In the drawing:

FIG. 3 is a bottom view of the golf ball retriever of FIG. 1 as seen in the direction of arrows 3—3;

FIG. 4 is a partial view of a mouth opening defined by the head part in FIG. 1, in slightly enlarged scale, and showing a golf ball entering the mouth opening;

FIG. 5 is an end view of the head part of FIG. 1, as seen in the direction of arrows 5—5 and showing a golf ball seated in the head part after entering the mouth opening;

FIG. 6 illustrates the present golf ball retriever in use with a golf club attached to the head part as a handle; and FIG. 7 is a sectional view of a handle part clamped by a clamping member on a neck portion of the head part in FIG. 1.

DETAILED DESCRIPTION OF THE INVENTION

Figure 1:
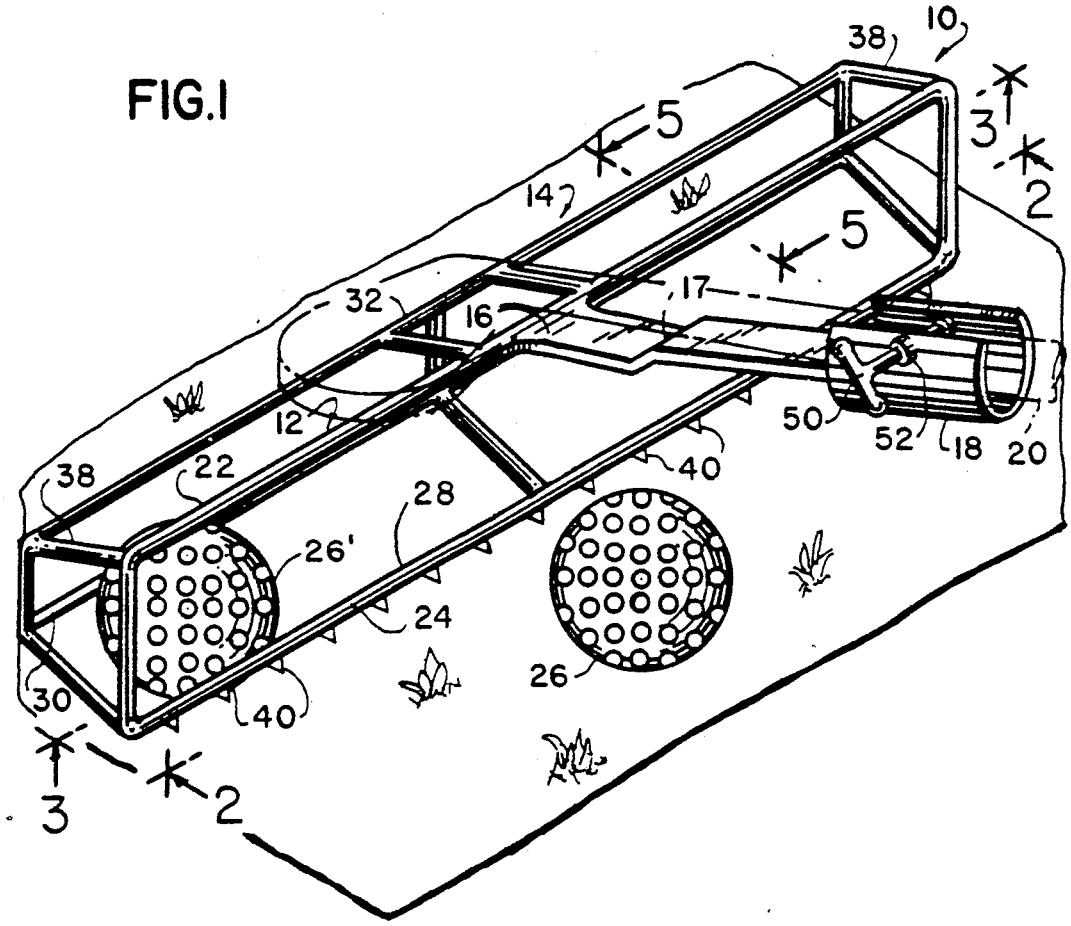
FIG. 1 is a perspective view of a head part of a golf ball retriever according to the invention.
Figure 2:
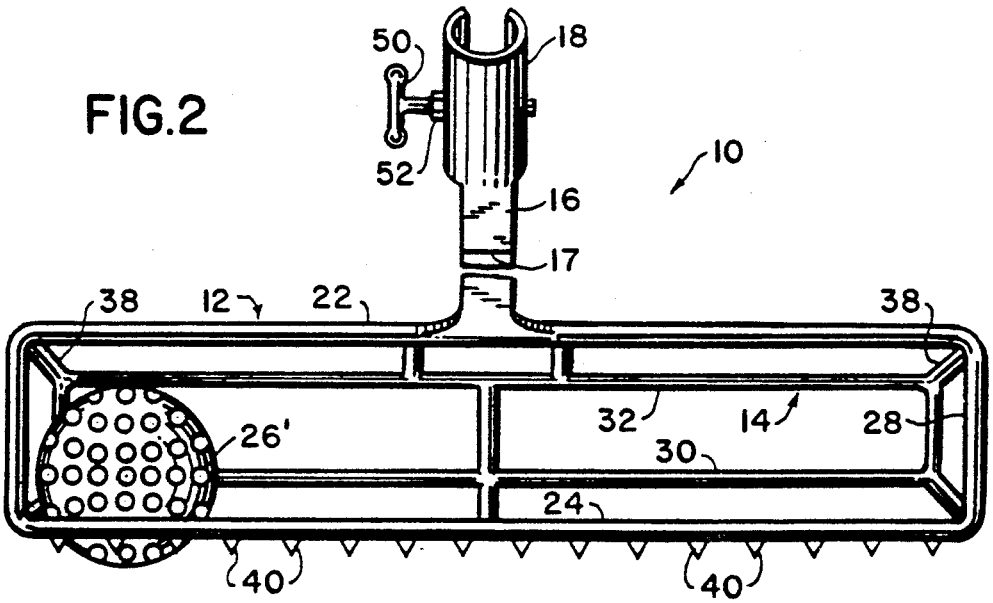
FIG. 2 is an elevational view of the golf ball retriever looking in the direction of arrows 2—2 in FIG. 1.

FIG. 1 is a perspective view of a head part 10 of a golf ball retriever according to the invention.

Head part 10 has an elongate form and includes a forward frame part 12 and a rear frame part 14. A central neck portion 16 extends perpendicularly from the long direction of head part 10. Neck portion 16 is formed with a rising offset 17 of about ¾ inch rise, and has an adjustable clamp member 18 fixed at its distal end. Clamp member 18 is provided for enabling a handle part 20, for example, the head end of a golf club to be fixed to the head part 10 when the golf ball retriever is to be used. The offset 17 allows the shaft part of the golf club to seat firmly against the distal end of neck portion 16, while the wider head end remains clear of the head part 10.

The forward frame part 12 is formed in part by a rod-like upper leading member 22 and a rod-like lower leading member 24. Upper and lower leading members 22, 24 are spaced apart enough so that a stationary golf ball 26 can enter a mouth opening 28 defined by the forward frame part 12 when the lower leading member 24 is swept beneath the golf ball 26. Once a golf ball passes through the mouth opening 28, such as the ball 26', it becomes seated between the lower leading member 24 and a lower trailing member 30 which forms a part of the rear frame part 14. See FIG. 5.

The rear frame part 14 also includes an upper rod-like trailing member 32. Lower trailing member 30 is spaced from the upper trailing member 32 less than the diameter of a golf ball so that after entering the mouth opening 28, the golf ball 26' will be prevented from escaping from the head part 10 in the direction in which the golf ball enters the mouth opening 28.

In order to ensure that the ball 26' is well-seated or captured by the head part 10 after passing through the mouth opening 28, the lower trailing member 30 defines a rear seat edge parallel to the lower leading member 24 of the forward frame part 12, which edge is spaced from the lower leading member 12 a distance slightly less than the diameter of the golf ball. That is, as shown in FIG. 5, it is preferred that the golf ball 26' project downwardly from the head part 10 between the lower leading member 24 and the lower trailing member 30 by an amount sufficient so that when the head part is raised and moved about, the golf ball will not tend to roll out from the mouth opening 28 while being retrieved.

The forward frame part 12 and the rear frame part 14 are joined to one another by rod-like members 38 at corresponding corners of the frame parts 12, 14 and at intermediate locations as shown in the drawing figures.

As shown in FIG. 4 the upper and lower leading members 22, 24 of forward frame part 12 are spaced apart a distance A slightly greater than the diameter G of the golf ball 26. That is, the spacing A between the parallel members 22, 24 must be such as to enable a golf ball to enter the mouth opening 28 when the lower leading member 24 of the forward frame part 12 is swept beneath the golf ball 26. Depending on the material of which the head part 12 including the leading members 22, 24, is constructed or formed, an optimum spacing A may vary to some degree.

It is presently contemplated that the head part 12 can be formed of a durable, rigid plastics material thus lending itself to easy manufacture by way of molding the frame parts 12, 14 integrally, together with the central neck portion 16. Clamp member 18 may be provided separately in the form of an adjustable collar for encircling and clamping the neck portion 16 and the periphery of the handle part 20, or can also be formed integrally with the neck portion 16.

The entire head part 10 can also be formed of wire rod and sheet metal material, and may be coated at least partly with protective plastics.

It has been found that the upper and lower leading members 22, 24 should have a diameter of about ¼ inch, and the trailing members 30, 32 have a diameter of about 3/16 inch. That is, the diameter of the trailing members 30, 32 is preferably less than that of the leading members 22, 24.

A number of forwardly directed downwardly inclined tooth-like projections 40 extend along the length of the lower leading member 24 of the front frame part 12 see FIG. 5. The projections 40 apply a dislodging force on golf balls enbedded in the ground or in the bottom surface of a body of water such as a pond. Projections 40 are spaced apart by distances less than the diameter of a golf ball, preferably every ¾ of an inch. Further, the projections 40 may also be of such form and dimension to allow for the raking of sand traps after a ball is retrieved from the trap by a golfer.

The tooth-like projections 40 preferably extend between 3/16 to 3/8 of an inch from the lower leading member 24 with a downward inclination as shown in FIG. 5.

The overall length of the mouth opening 28 may be, for example, up to about 12 inches, thus allowing as many as 6 to 7 golf balls to be retrieved at a time by the head part 10.

As shown in FIG. 5, neck portion 16 extends initially about one inch from the upper leading member 22 with a slight upward inclination, in line with the connecting rod members 38. After the offset 17, the neck portion 16 continues about 2–3 inches to its distal end.

The handle part 20, when clamped to the neck portion of head part 10, should extend from the head part at such an angle that the lower leading member 24 can be urged against the ground or water bottom surface for dislodging embedded golf balls.

When needed for use, the retriever head part 10 may be clamped as shown in FIGS. 1 and 6 to the head end of a golf club 20. If it is desired to retrieve one or more golf balls from the bottom of a pond or stream, a conventional telescoping pole up to about 18 feet in length may instead be clamped to the head part 10 via the clamping member 18. As shown in FIG. 7, a "wing" type of bolt 50 having a shoulder 52 engages threads in the clamp member 18 so as to cause the member 18 to clamp about the periphery of the handle 20 and thus fix it securely to the head part 10 as the wing nut 50 is tightened. It will of course be necessary to remove the bolt 50 initially to allow the head end of the golf club 20 to be urged into the clamp member 18 prior to the tightening of the clamp member by the bolt 50.

When in use, as shown in FIG. 6, the golfer merely applies a slight downward force on the handle 20 while retrieving one or more golf balls. This downward force together with the series of inclined, tooth-like projections 40 on the lower leading member 24 will allow the projections 40 to apply a dislodging force to golf balls embedded in sand, mud or silt at the bottom of a pond or stream. Once dislodged, the balls will easily enter the mouth opening 28 of the forward frame part 12 and become seated between the lower leading and trailing members 24, 30 as shown in FIG. 5. As mentioned, the projections 40 will also allow the head part 10 to act as a sand rake.

With the presently disclosed construction, it has been discovered that a golfer need not actually see the golf balls to retrieve them, but need only drag the head part 10 along the bottom surface of a body of water while applying the slight downward pressure on the handle 20. Once the projections 40 encounter an embedded golf ball, the user will actually "feel" the golf ball pop up out of the bottom surface, enter the mouth opening 28 and become seated in the head part 10 as depicted in FIG. 5.

While the foregoing description represents a preferred embodiment of the invention, it will be obvious to those skilled in the art that various changes and modifications may be made, without departing from the true spirit and scope of the invention as pointed out in the following claims.

What is claimed is:

1. A golf ball retriever, comprising;

an elongate head part for retrieving golf balls on land or from a body of water, said head part comprising:

a forward open frame part defining a generally rectangular mouth opening with parallel upper and lower leading members spaced apart enough so that a stationary golf ball can enter the mouth opening when the lower leading member of the forward frame part is swept beneath the golf ball, and a rear open frame part for preventing golf balls entering said mouth opening from escaping from the head part in the direction in which the golf balls enter said mouth opening, said rear frame part having parallel upper and lower trailing members spaced apart less than the diameter of a golf ball, said lower trailing member defining a rear seat edge parallel to the lower leading member of the forward frame part and spaced from the lower leading member a distance slightly less than the diameter of a golf ball so that the golf ball can be seated between the rear seat edge and the lower leading member after entering said mouth opening;

means for connecting said forward frame part to said rear frame part, in open spaced relation relative to one another, including rigid rod like members extending between the upper leading and trailing members, and between the lower leading and trailing members, respectively; and means for fixing one end of a handle to the head part; and wherein said forward frame part has a number of forwardly directed, downwardly inclined projections spaced from one another along the length of the lower leading member, for applying a dislodging the force on golf balls embedded in a ground or water bottom surface; and said fixing means is arranged so that an attached handle will apply a pulling force to said head part and enable the projections along the length of the lower leading member to be urged against and underneath a golf ball embedded in the ground or water bottom surface for dislodging the ball and causing the ball to be directed into the mouth opening of the forward frame part.

2. A golf ball retriever according to claim 1, wherein said projections are spaced apart by distances less than the diameter of a golf ball.

3. A golf ball retriever according to claim 1, wherein said fixing means includes clamp means for detachably clamping said handle to said head part.

4. A golf ball retriever according to claim 3, wherein said head part has a central neck portion extending perpendicularly from the long direction of the head part, and said clamp means includes an adjustable clamp member for encircling and clamping the periphery of said handle to said neck portion.

5. A golf ball retriever according to claim 3, including a golf club which forms said handle.

6. A golf ball retriever according to claim 1, wherein said projections are formed and dimensioned for raking of sand.

7. A golf ball retriever according to claim 3, including a telescoping pole which forms said handle.

8. A golf ball retriever according to claim 1, wherein said forward frame part and said rear frame part are formed integrally.

9. A golf ball retriever according to claim 4, wherein said forward frame part, said rear frame part, and said central neck portion are formed integrally.

10. A golf ball retriever capable of retrieving golf balls from a ground surface or when embedded in a bottom surface underwater, comprising:

a head part comprising a forward open frame part and a rear open frame part joined to said forward frame part in open spaced relation relative to one another;

said forward frame part including a rigid, rod like upper leading member and a rigid, rod-like lower leading member which members together define a mouth opening for receiving a golf ball;

a plurality of forwardly directed, downwardly inclined projections spaced from one another along the length of the lower leading member, for applying a dislodging force on golf balls embedded in a ground surface or in a bottom surface underwater;

said rear frame part including a rigid, rod-like upper trailing member and a rigid, rod-like lower trailing member spaced from said upper trailing member by less than the diameter of a golf ball so that after a golf ball enters the mouth opening of said forward frame part, the golf ball is prevented from escaping the head part in a direction in which the ball enters the mouth opening;

said lower trailing member defining a rear seat edge parallel to the lower leading member of the forward frame part and spaced from the lower leading member a distance less than the diameter of a golf ball so that the golf ball can be seated between the rear seat edge and the lower leading member after entering said mouth opening;

means for connecting said forward frame part to said rear frame part, including rigid rod like members extending between the upper leading and trailing members, and between the lower leading and trailing members respectively; and means for fixing one end of a handle to said head part;

wherein said fixing means includes a neck portion extending perpendicularly from the upper leading member of said forward frame part, for transmitting a pulling force from an attached handle to the head part and for enabling the projections to be urged against and underneath a golf ball embedded in the ground or bottom surface underwater for dislodging the ball and causing the ball to be directed into the mouth opening of the forward frame part.

11. The golf ball retriever of claim 10, wherein said neck portion has a rising offset for allowing a shaft part of a golf club to seat firmly against a distal end of the neck portion while a head end of said club remains closer of said head part.

12. The golf ball retriever of claim 10, wherein the lower leading member of said forward frame part is spaced from the lower trailing member of said rear frame part by an amount such that when the head part is raised and moved, a golf ball received in said head part tends to remain seated rather than roll out through the mouth opening of the forward frame part.

13. The golf ball retriever of claim 10, wherein said forward frame part and said rear frame part are joined to one another by rigid rod-like members at corresponding corners of the frame parts.

14. The golf ball retriever of claim 13, wherein the forward frame part and the rear frame part are joined to one another by rigid rod-like members at locations intermediate the corners of said frame parts.

15. The gold ball retriever of claim 11, wherein the rising offset of said neck portion of said fixing means provides an upwardly inclined rise of about $\frac{3}{4}$-inch from a part of the neck portion attached to said upper leading member, to a distal end part of said neck portion.

* * * * *